US011293636B2

(12) United States Patent
Bertilsson

(10) Patent No.: US 11,293,636 B2
(45) Date of Patent: Apr. 5, 2022

(54) APPARATUS AND METHOD FOR CLEANING SMELT SPOUTS AND SMELT DISCHARGE OPENINGS OF A CHEMICALS RECOVERY FURNACE OR BOILER

(71) Applicant: Mats Bertilsson Förvaltning AB, Kungsbacka (SE)

(72) Inventor: Mats Bertilsson, Kungsbacka (SE)

(73) Assignee: Mats Bertilsson Förvaltning AB, Kungsbacka (SE)

( * ) Notice: Subject to any disclaimer, the term of this patent is extended or adjusted under 35 U.S.C. 154(b) by 22 days.

(21) Appl. No.: 16/483,768

(22) PCT Filed: Feb. 6, 2018

(86) PCT No.: PCT/SE2018/050110

§ 371 (c)(1),
(2) Date: Aug. 6, 2019

(87) PCT Pub. No.: WO2018/147788

PCT Pub. Date: Aug. 16, 2018

(65) Prior Publication Data

US 2020/0025373 A1 Jan. 23, 2020

(30) Foreign Application Priority Data

Feb. 8, 2017 (SE) ..... 1730035-1

(51) Int. Cl.
*F23J 1/06* (2006.01)
*D21C 11/10* (2006.01)
(Continued)

(52) U.S. Cl.
CPC ..... *F23J 1/06* (2013.01); *D21C 11/106* (2013.01); *F23G 7/04* (2013.01); *F23J 1/08* (2013.01); *F27D 3/15* (2013.01); *F27D 25/00* (2013.01)

(58) Field of Classification Search
None
See application file for complete search history.

(56) References Cited

U.S. PATENT DOCUMENTS 4,423,533 A 1/1984 Goodspeed
4,706,324 A 11/1987 Goodspeed
(Continued)

FOREIGN PATENT DOCUMENTS

EP 1914477 A2 4/2008
GB 560129 A 3/1944
(Continued)

OTHER PUBLICATIONS

Mats Bertilsson Förvaltning AB, International Application No. PCT/SE2018/050110, International Search Report, dated Mar. 14, 2018.

(Continued)

*Primary Examiner* — Mikhail Kornakov
*Assistant Examiner* — Pradhuman Parihar
(74) *Attorney, Agent, or Firm* — Moore & Van Allen PLLC; W. Kevin Ransom

(57) ABSTRACT

An apparatus comprising a cleaning rod driven in reciprocating, axial extension (y) and retraction (x) movements upon cleaning a smelt discharge opening of a chemicals recovery boiler, wherein a linear actuator is controllable for driving the cleaning rod in the axial movements. A pivot actuation means is controllable for pivoting the cleaning rod about an axis (S) upon cleaning a smelt spout associated with the smelt discharge opening, wherein one or more sensors are arranged to provide control basis for correlation of the axial movements (x; y) with the change in pivot angle (φ) during pivoting of the cleaning rod. A method to be performed in use of the apparatus is likewise disclosed.

18 Claims, 7 Drawing Sheets

(51) Int. Cl.

| | |
|---|---|
| ***F23G 7/04*** | (2006.01) |
| ***F23J 1/08*** | (2006.01) |
| ***F27D 3/15*** | (2006.01) |
| ***F27D 25/00*** | (2010.01) |

(56) References Cited

U.S. PATENT DOCUMENTS

| | | | | |
|---|---|---|---|---|
| 4,822,428 | A | 4/1989 | Goodspeed | |
| 5,542,650 | A * | 8/1996 | Abel et al. | C21B 9/10 266/135 |
| 8,424,150 | B1 | 4/2013 | Higgins et al. | |
| 2008/0282486 | A1 | 11/2008 | Pingel | |
| 2009/0066169 | A1 * | 3/2009 | Schweiher et al. | H02K 41/035 310/14 |

FOREIGN PATENT DOCUMENTS

| | | | | |
|---|---|---|---|---|
| SE | WO03/093747 | A1 * | 11/2003 | F27D 3/15 |
| SE | WO2006/126929 | * | 11/2006 | D21C 11/12 |
| WO | 03093747 | A1 | 11/2003 | |
| WO | 2006126929 | A1 | 11/2006 | |
| WO | 2008044984 | A1 | 4/2008 | |
| WO | 2013071008 | A2 | 5/2013 | |

OTHER PUBLICATIONS

Mats Bertilsson Förvaltning AB, International Application No. PCT/SE2018/050110, Written Opinion, dated Mar. 14, 2018.

Mats Bertilsson Förvaltning AB, European Application No. 18751368.4, Extended European Search Report, dated Dec. 11, 2020.

Mats Bertilsson Förvaltning AB, International Application No. PCT/SE2018/050110, International Preliminary Report on Patentability, dated Aug. 13, 2019.

* cited by examiner

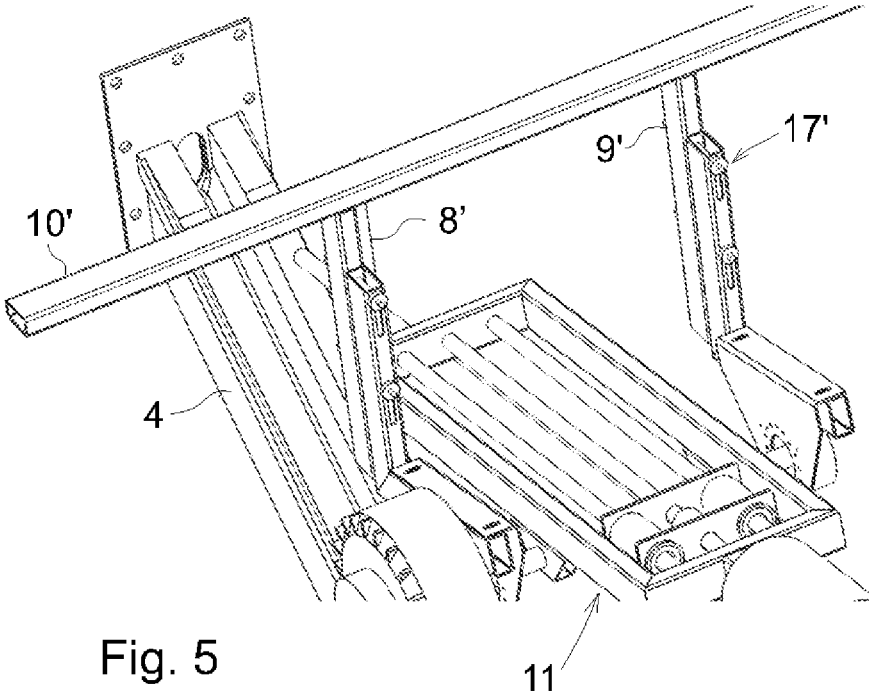
Fig. 5
Fig. 6
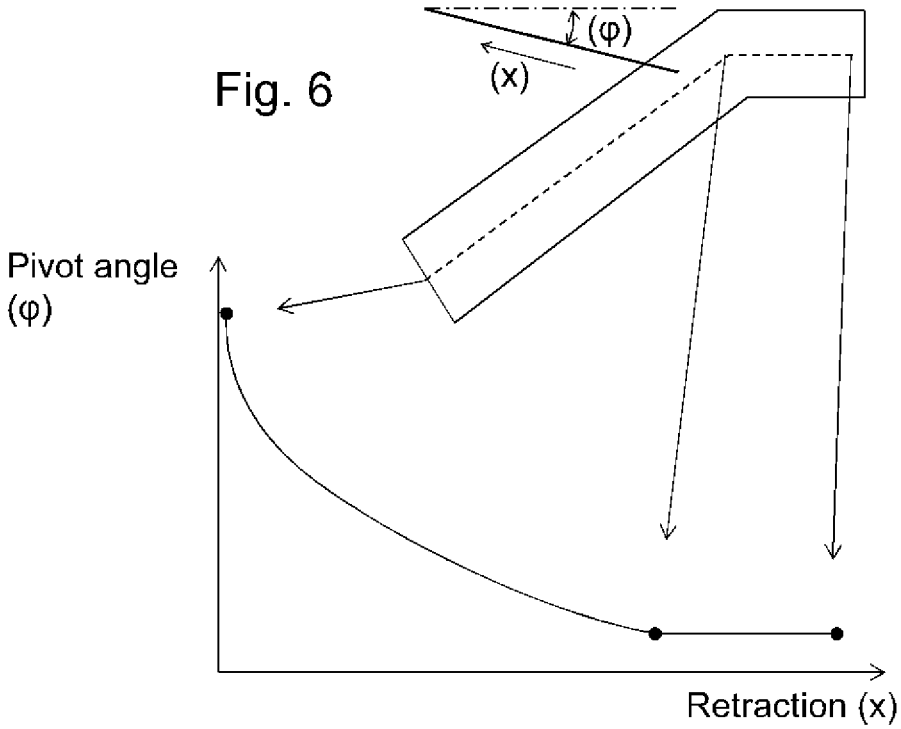

APPARATUS AND METHOD FOR CLEANING SMELT SPOUTS AND SMELT DISCHARGE OPENINGS OF A CHEMICALS RECOVERY FURNACE OR BOILER

CROSS-REFERENCE TO RELATED APPLICATIONS

This application is a national stage application (filed under 35 § U.S.C. 371) of PCT/SE2018/050110, filed Feb. 6, 2018 of the same title, which, in turn, claims priority to Swedish Application No. 1730035-1 filed Feb. 8, 2017; the contents of each of which are hereby incorporated by reference.

FIELD OF THE INVENTION

The present invention relates to an apparatus and a method for cleaning smelt spouts and smelt discharge openings in the wall of a chemicals recovery furnace or boiler.

BACKGROUND OF THE INVENTION

The method and device are advantageously used in an essential step in the production of chemical pulp. More specifically, said essential step relates to the recovery of pulp cooking chemicals from what is called black liquor, which is a rest product from such production in order to achieve chemical pulp with different specified properties. The chemical composition of these chemicals may, as a consequence, vary. The recovery takes place in a boiler wherein the temperature during the recovery process normally is in the order of about 1000° C. (1832° F.). At said temperature, the remaining wooden fiber is burnt and the pulp cooking chemicals may be recovered. Before its introduction into the boiler, the black liquor is concentrated to a water solution which contains about 65-90 percent of solid material. This solution is then sprayed into the recovery boiler, which is a kind of a chemical reduction furnace. A chemical reduction furnace is a reactor wherein processes of evaporation, gasification, pyrolysis, oxidation and reduction, occur mutually dependency during recovery of the chemicals. Organic materials such as lignin and other wood extracts maintain the combustion in the furnace, and the heat that is produced dries the spent cooking chemicals as they fall to the floor or bottom of the boiler. Here the dried chemicals pile up into a char bed. The char bed is further heated to form a liquid smelt that is discharged through one or more discharge openings and smelt spouts in a lower part or bottom of the boiler.

The combustion process requires the introduction of large volumes of air into the boiler. This air amounts to about 80 percent of the material introduced in the boiler.

The air is forced into the boiler from wind boxes or ducts disposed at several levels in surrounding relationship to the boiler, through a plurality of air inlet ports in the walls of the boiler, viz.: primary, secondary and tertiary air inlet ports. The primary air inlet ports, through which about 40 to 50 percent of the air is introduced, are disposed in the side walls in a lower portion of the boiler, close to the char bed. The secondary air inlet ports, through which about 35 percent of the air is introduced, are disposed around the boiler at higher level than the primary air inlet ports, and below the entry through which the black liquor is sprayed into the boiler. While the primary air inlet ports provide a relatively large volume of air with considerable turbulence for maintaining a fireball in the char bed, the secondary air inlet ports provide a finer control and distribution of air above the char bed and distribute the air evenly in the black liquor spray to support the combustion thereof. The black liquor sprayed into the boiler, having a consistency similar to heated oil, swirls, burns and falls towards the bottom of the boiler in the form of combustion products comprising char material and smelt.

Some of the smelt and char material that comes into contact with the wall of the boiler will be cooled by the inflowing air, thus building up deposits around the periphery of the air inlet ports. In accordance with customary practice, the char buildup is periodically dislodged, either manually by a worker inserting a rod into the air inlet ports, or by a mechanical cleaning apparatus. The dislodged char material falls into the smelt pool in the bottom of the boiler. A mechanical cleaning apparatus for cleaning air inlet ports in a recovery boiler is previously known from U.S. Pat. No. 4,423,533.

Smelt spouts are on the other hand designed to drain the smelt from the boiler, and to keep the smelt pool at a safe level. If the smelt spout is not cleaned periodically, the smelt will oxidize and form a crust which will clog the smelt spout. Clogged smelt spouts can cause the level of smelt inside the boiler to rise, resulting in inefficient and unpredictable operation, resulting in a reduction in the amounts of chemicals that can be recovered, a decrease in the amount of steam produced per unit of fuel, and increased emission of noxious gases such as carbon monoxide and sulfur dioxide.

Smelt spouts of soda recovery boilers are often cleaned manually by a worker inserting a long metal rod into the spout. Vigorous lateral and reciprocating movements of the rod by the worker dislodges any char or oxidized encrusted smelt that will be clogging the spout. Such manual rodding of the smelt spout is inefficient and also extremely unsafe. The temperature of the smelt amounts to an order of 1000° C., and although the rods utilized to clean the spouts are usually up to six meters long or more, there is great danger that a worker who manually rods such smelt spouts can be burned. Smelt spout openings are, due to the high temperature, cooled by water circulating in jackets surrounding both the discharge opening of the boiler and the spout, and during rodding the water jackets can be ruptured by the manual rodding operation, A broken water jacket may result in an explosion of the boiler because of the volatility of the smelt in the presence of water. One cubic meter of water released results in 8000 cubic meters of steam released in just a moment of time. A mechanical device for cleaning a smelt spout and discharge opening in the wall of a soda recovery boiler is previously disclosed in WO 2008/044984. A rod-shaped cleaning tool is rotationally arranged about its longitudinal axis in a carrier that is movably supported on wheels. The carrier and tool can be driven in reciprocating motion for moving the cleaning tool back and forth through the discharge opening and along the path of the smelt spout, which extends at a downwards slanting angle from the discharge opening in the boiler wall.

The present invention refers to an apparatus comprising a cleaning rod driven in reciprocating, axial extension and retraction movements upon cleaning a smelt discharge opening of a chemicals recovery boiler, wherein a linear actuator is controllable for driving the cleaning rod in the axial movements.

A cleaning apparatus of similar kind is previously known from U.S. Pat. No. 5,542,650 A (see FIGS. 25-30). In a cleaning sequence of dislodging encrusted material from the smelt spout, the cleaning rod is freely pivoting on a trunnion mount to allow the rod to move upwardly or downwardly along the spout while the rod is extended or retracted by the linear actuator. In an attempt to avoid contact of the cleaning rod with the bottom of the smelt spout, U.S. Pat. No. 5,542,650 A suggests that the cleaning rod be guided from a roller assembly that runs on edges of side walls to the smelt spout. It can however easily be foreseen that this solution may suffer badly from the harsh environment including high temperatures and splashes that would in practice hamper the operation of the roller assembly.

SUMMARY OF THE INVENTION

It is an object of the present invention to provide an alternative and improved apparatus for cleaning smelt spouts and discharge openings in the wall of a chemicals recovery boiler.

Another object of the present invention is to provide a not only improved but fully safe method for cleaning smelt spouts and discharge openings in the wall of a chemicals recovery boiler by use of a cleaning apparatus that is installable for operation in alignment with a smelt spout and smelt discharge opening.

Another object of the present invention is to provide an improved cleaning apparatus and method aimed for increasing the operational stability of a chemicals recovery boiler. Still another object of the present invention is to provide an improved cleaning apparatus and method aimed for reducing the exposure of workers to hazardous areas of a chemicals recovery boiler.

Yet another object of the present invention is to provide an improved cleaning apparatus that is safe to operate, and virtually eliminates the risk of rupturing the smelt spout during cleaning.

Still another object of the present invention is to provide an improved cleaning apparatus that is relatively light in weight and which can be manually installed or removed from a chemicals recovery boiler, quickly and easily as compared to prior art solutions.

It is finally an object of the present invention to provide a cleaning apparatus for installation in fixed or temporarily fixed relation to the smelt spout and discharge opening in the wall of a chemicals recovery boiler. Misalignment or dislocation caused by thermal expansion of the boiler body is thereby avoided or reduced to a minimum.

At least some of these objects are met in an apparatus comprising a cleaning rod driven in reciprocating, axial extension and retraction movements upon cleaning a smelt discharge opening of a chemicals recovery boiler, wherein a linear actuator is controllable for driving the cleaning rod in the axial movements. A pivot actuation means is controllable for pivoting the cleaning rod about an axis upon cleaning a smelt spout associated with the smelt discharge opening. One or more sensors are arranged to provide control basis for correlation of the axial movements with the change in pivot angle during pivoting of the cleaning rod.

The combination of movements and actuator control built into the cleaning apparatus so defined provide the technical and operative conditions required for automation, thus offering the possibility for avoiding hazardous, manual cleaning work. In that sense, the cleaning apparatus may be seen as an automatic or at least semiautomatic robot which only requires, at its utmost, a start signal from an operator to initiate a cleaning sequence. If a fully automatic procedure is aimed for, this can be achieved by arranging the start of the cleaning sequence dependent on certain conditions relating to the chemicals recovery process. One such condition that can be monitored and forming a basis for commencement of cleaning is, e.g. the temperature in the smelt spout which can be monitored by a temperature sensor.

In one embodiment, the cleaning apparatus comprises one or more sensors monitoring at least one of the rod axial and pivoting movements, wherein the operation of at least one of the linear actuator and the pivot actuation means is based on output from the one or more sensors.

In one embodiment, the pivot actuation means is arranged for adjusting the speed of the pivoting movement based on readings from a rod axial motion sensor monitoring the axial movements during pivoting of the cleaning rod. A rod axial motion sensor can be realized as one of: a proximity sensor; one or more limit switches or an end position sensor; or an encoder in a servomotor of the linear actuator, e.g.

The linear actuator is in one embodiment arranged for adjusting the speed of axial movement based on readings from an angle position sensor which is monitoring the change in pivot angle during pivoting of the cleaning rod.

An angle position sensor can be realized as one of: a set of light sensors or photo cells monitoring the pivot area of the cleaning rod; a fixed position video camera with associated image processing software; or an encoder in a servomotor of the pivot actuation means, e.g.

The axial and pivoting movements can thus both be actively controlled and balanced such that speed or amount/length of axial travel is proportionate to applied speed or amount of change in angular position during pivoting. In this disclosure, the coordination of axial and pivoting movements is defined as "correlation", in order to underline that each movement depends on the other. This correlation between axial and pivoting movements provides the technical effect and advantage that damage to the smelt spout can be avoided by ensuring that the cleaning rod travels along the smelt spout under maintenance of a clearance to the metallic bottom of the smelt spout. The cleaning apparatus may be arranged for supporting the cleaning rod in permanent or temporary alignment with the smelt spout and the smelt discharge opening. These features provide the optional implementation of one cleaning apparatus per each smelt spout/discharge opening in the boiler, or the choice of successively cleaning the smelt spouts/discharge openings by use of a movable cleaning apparatus that can be shifted from one smelt spout to the other.

In one embodiment, the cleaning apparatus is supported in a fixture that is connectable to the boiler. In alternative embodiments the cleaning apparatus may be supported in a fixture which is freestanding from the boiler, although it may be located in fixed relation to the boiler.

These features can be alternatingly applied in set-ups where boiler movement caused by thermal expansion needs to be accounted for. Thus, in the first mentioned alternative the cleaning apparatus is arranged to follow any movement of the boiler that is due to thermal expansion, whereas in the second alternative thermal expansion is not allowed to affect the suspension and alignment of the cleaning apparatus. In one embodiment a fixture frame comprises, in a side facing the boiler, positioning means mating with corresponding positioning means arranged on an adapter that is connectable to the boiler.

This embodiment ensures a correct alignment with the smelt spout and discharge opening through a forced mating between the cleaning apparatus and a docking member attached to the boiler.

The following features and details define advantageous embodiments of the cleaning apparatus:

The cleaning rod is supported in a swing that is pivotally arranged between a couple of arms, one end of which, respectively, is anchored in the fixture or the boiler wall.

In one embodiment, the swing comprises a rack and pinion drive, or a ball-screw, or a trapezoidal threaded bar mechanism operable for moving a driver, in which the cleaning rod is anchored for axial movements in extension and retraction.

In one embodiment, the change in angular position of the cleaning rod is monitored by an angle position sensor which is operatively coupled to a pivot axis of the cleaning rod or the swing.

The pivot actuation means may be an angular actuator or a linear actuator.

The cleaning apparatus may be pivotally connected to the boiler.

In one embodiment, the cleaning rod is pivotally supported in the outer ends of a couple of arms, the inner ends of which are pivotally journaled at the boiler.

The latter embodiment provides overload protection for the cleaning apparatus, in particular for the components of a cleaning rod drive mechanism included in the cleaning apparatus.

A pivotal connection of the cleaning apparatus to the boiler further adds to the protection of the smelt spout by permitting the cleaning apparatus to "lift" from the spout in case the cleaning rod, accidentally, would hit heavily against the bottom of the smelt spout.

The objects of the invention are likewise met in a method of cleaning a smelt spout and a smelt discharge opening of a chemicals recovery boiler by using a cleaning apparatus comprising a cleaning rod driven in reciprocating, axial extension and retraction movements, wherein the method comprises: sequentially extending and retracting the cleaning rod in a step of cleaning the smelt discharge opening; and pivoting the cleaning rod in a step of cleaning the smelt spout, wherein axial movements are correlated with the change in pivot angle during pivoting of the cleaning rod based on readings from one or more sensors.

The method may further comprise the steps of:

monitoring the change in pivot angle during the pivoting movement, and adjusting the speed of the axial movement based on readings of the change in pivot angle.

More precisely, in one embodiment, the speed of the axial movement is increased progressively with increasing pivot angle.

In an alternative embodiment, the method comprises the steps of:

monitoring the axial movement of the cleaning rod during the pivoting movement, and adjusting the speed of the pivoting movement based on readings of the axial movement.

During the pivoting motion, the tip of the cleaning rod is advantageously maintained at a distance within about 1 mm to 50 mm from the bottom of the smelt spout, or at a minimum distance of about 1 mm to 20 mm from the bottom of the smelt spout. In a further step of automation of the cleaning process, initiation of a cleaning session is based on readings from a temperature sensor that monitors the temperature in the smelt spout.

BRIEF DESCRIPTION OF THE DRAWINGS

The invention will be further explained below with reference made to the accompanying, schematic drawings, wherein FIG. 5 shows an alternative installation of the cleaning apparatus in the boiler building, FIG. 6 is a diagram showing the relation between change in pivot angle and speed of retraction of a cleaning rod during pivoting of the cleaning rod.

DETAILED DESCRIPTION OF THE INVENTION

Figure 1:
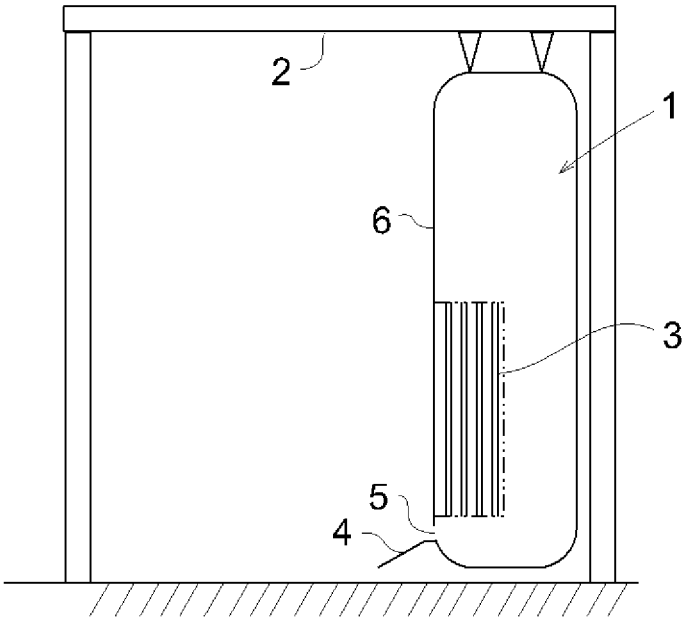
FIG. 1 shows an installation of a chemicals recovery boiler in a building.

With reference to FIG. 1, a chemicals recovery boiler 1 is shown schematically. The boiler 1 is suspended from an upper structure 2 of a building that houses the boiler. A cooling jacket, indicated by reference number 3, is typically arranged on the exterior of the boiler. The cooling jacket 3 typically comprises an array of conduits in which water is circulated. Smelt products can be discharged from the boiler via a smelt spout 4 that extends at a downwards slanting angle from a smelt discharge opening 5 in the wall 6 of the boiler 1. The smelt spout 4 is typically oriented in a plane that is perpendicular to the boiler wall 6. In fact, a number of smelt spouts 4 and discharge openings 5 may be distributed around the body of the boiler.

Figure 2A:
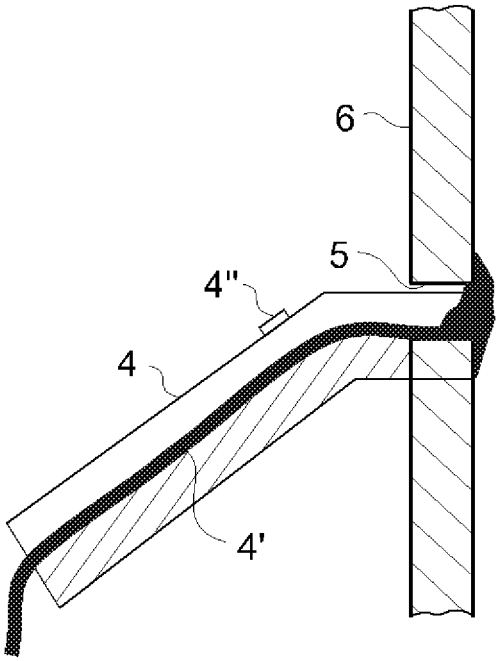
FIGS. 2*a* and 2*b* show a cut out detail of the boiler of FIG. 1 on a larger scale.
Figure 2B:
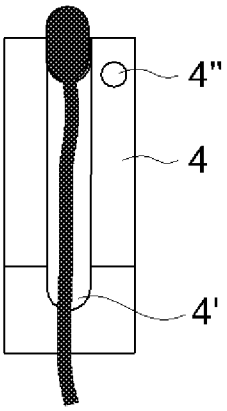

In FIG. 2*a*, the smelt spout 4, discharge opening 5 and a cut out portion of the boiler wall 6 are shown in a side view, substantially in parallel with the boiler wall. FIG. 2*b* shows the smelt spout of FIG. 2*a* in a front view, perpendicularly to the boiler wall. The solid black string and plug in FIGS. 2*a* and 2*b* is a schematic representation of smelt material which has cooled down in the smelt spout and is clogging the discharge opening. In FIGS. 2*a* and 2*b*, reference number 4' points to the bottom of the smelt spout 4. Since encrustation of smelt in the smelt spout is usually related to the temperature in the smelt, the necessity of cleaning the smelt spout from encrustations can be determined by monitoring the temperature in the smelt spout. To this purpose a temperature sensor 4" may be arranged on the smelt spout. A heat camera may alternatively be arranged to measure the temperature in the smelt that is pouring down the spout. The readings from the temperature sensor 4" or heat camera can form the basis for an automatic initiation of a cleaning session, if appropriate.

An apparatus 7 arranged for cleaning and removing encrusted material from the discharge opening 5 and from the smelt spout 4 will now be described with reference made to the left and right-hand perspective views of FIGS. 3 and 4 respectively. The subject embodiment of the cleaning apparatus 7 comprises a frame including two parallel arms 8 and 9, reaching from an inner end that is pivotally journaled at the boiler wall 6 to an outer end which provides pivotal suspension of a drive mechanism 1 1 for a cleaning rod (which later will be described). More precisely, in the illustrated embodiment the arms 8 and 9 are pivotally journaled in a fixture frame 10 which is arranged to be connected to the boiler wall 6.

The fixture frame 10 is a box-like design comprising left and right support sections 12 and 13, defining between them a central slot 14 which is dimensioned to receive an upper end of the smelt spout 4 as the fixture frame 10 and cleaning apparatus 7 are aligned with the smelt spout and the discharge opening 5.

Each support section 12 or 13 comprises a set of reinforcement elements 15 designed to take up the load from the cleaning apparatus via a sub-frame 16, by which sub-frame the inner end of each arm is journaled pivotally in the fixture frame 10, on a pivot 17 respectively. To be more specific, the sub-frames 16 extend below the arms 8 and 9 so as to support the cleaning apparatus 7 in a mainly horizontal position from which the cleaning apparatus is permitted to move pivotally upwards, for reason which will be discussed below.

As disclosed herein, basically, the arms 8, 9 can be designed as self-supported or cantilever members. However, in alternative embodiments, the free outer ends of the arms 8 and 9 may be supported from the boiler building, such as suspended in ropes hanging down from a structural element in the building. If appropriate, suspension of the outer ends of the arms 8 and 9 may include a degree of elasticity, such as through tension springs inserted in supporting ropes, e.g.

The cleaning apparatus 7 can be arranged for permanent or temporary alignment with the smelt spout 4 and the discharge opening 5. In this connection, alignment refers on one hand to the orientation of the cleaning apparatus in parallel with the smelt spout as seen in a horizontal plane, and to the positioning of the cleaning apparatus with respect to the vertical height of the smelt discharge opening on the other hand. In permanent alignment, the fixture frame 10 can be mounted to the boiler wall or to any structural element which is attached to the boiler wall. Permanent alignment may alternatively foresee that the cleaning apparatus is stationary supported in a structure that is freestanding from the boiler. An example of the latter is given in FIG. 5, for the purpose of illustration. In this embodiment, the arms 8' and 9' are designed as angled consoles, depending from a fixture beam 10'. The beam 10' may be anchored in a structural element of the boiler building or may itself constitute a structural element of the building. In the embodiment of FIG. 5 the vertical height can be adjusted by arranging the arms 8', 9' extendable as suggested through the bolt and long-hole connection 17'. Suspension of the cleaning apparatus on bolts which are inserted through oblong holes formed in the arms 8' and 9' further provides a form of overload protection to prevent excessive loads from being transmitted to the components of the cleaning apparatus by permitting the cleaning apparatus to move upwards while sliding on the bolts.

In temporary alignment, the cleaning apparatus may be movably supported in a structure that is freestanding from the boiler, or movably supported in a structure that is connectable to the exterior of the boiler. In a case where the cleaning apparatus is to be moved from one smelt spout to another in sequential cleaning operations, e.g., the cleaning apparatus may be arranged movable on a rail that runs horizontally at a fixed distance from the boiler. Such a rail can be supported in structural parts of the boiler building, or supported on the exterior of the boiler.

Albeit there are several options available for a skilled person to adapt the suspension of the cleaning apparatus to a specific boiler application through a corresponding design of supporting structures, an essential aspect and requirement in any application is the correct alignment between the cleaning apparatus on one hand, and the smelt spout and discharge opening in the boiler wall on the other hand. Affordable tolerances in this respect should preferably be defined in millimeters in order to avoid harmful contact with the boiler wall and the smelt spout during the cleaning operation.

Figure 3:
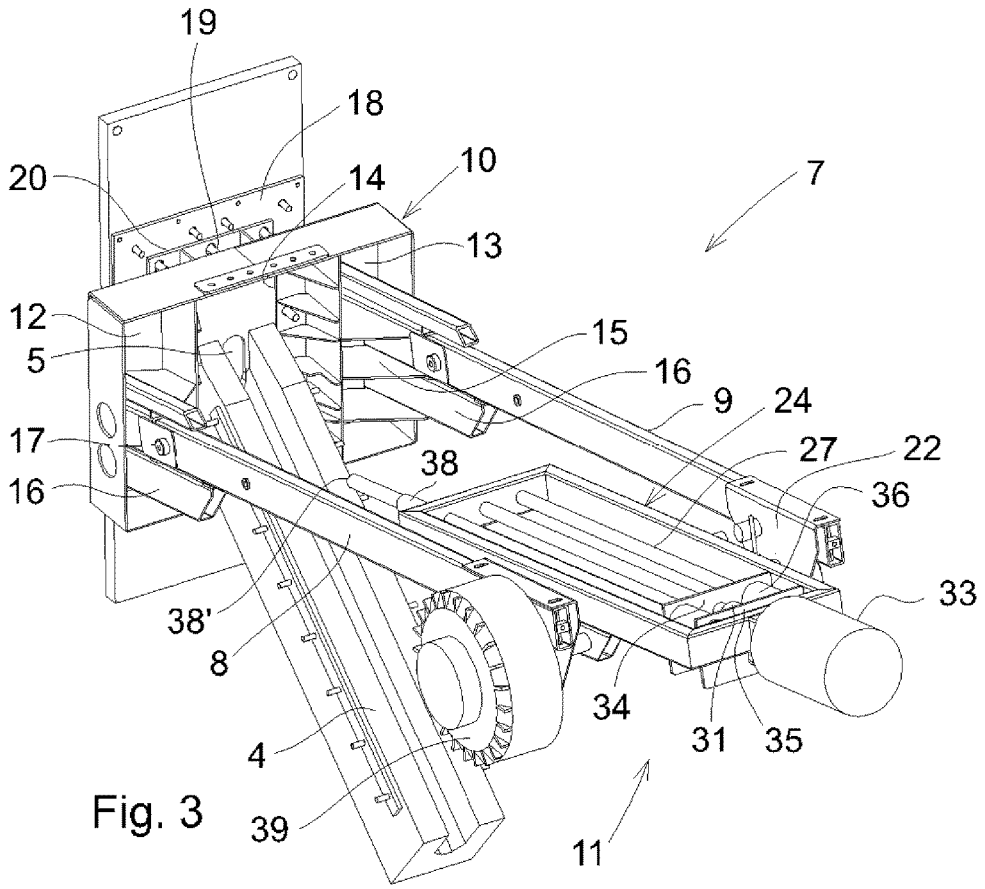
FIG. 3 is a perspective view of one embodiment of the cleaning apparatus of the present invention.
Figure 4:
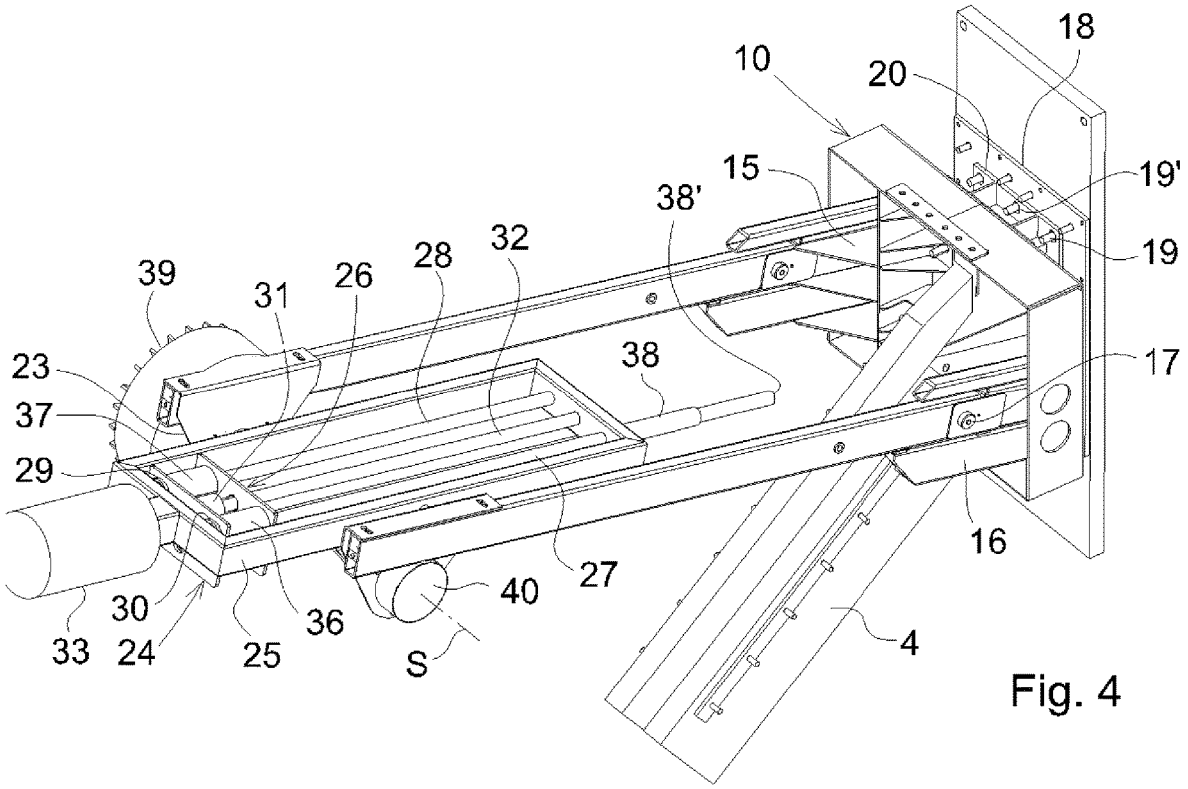
FIG. 4 is a corresponding perspective view showing the cleaning apparatus of FIG. 3 from the opposite side.

In the embodiment of FIGS. 3 and 4, the required precision is achieved in that the cleaning apparatus 7 is arranged for docking with an adapter element 18 that is mountable on the boiler. A correct alignment and positioning, horizontally as well as vertically, is accomplished by mating the fixture frame 10 with positioning means 19 formed on the adapter element 18. The positioning means 19 can be realized in the form of studs 19, which project from the adapter element 18 for insertion in corresponding holes 19' that are formed in the opposite side 20 of the fixture frame, facing the boiler and the adapter element. The studs 19 can be threaded bolts for permanent connection of the cleaning apparatus 7 to the boiler wall/adapter element. Of course, any suitable interacting means and guides, besides the mentioned studs or bolts and stud or bolt holes, may be used to urge the cleaning apparatus into mating position with the smelt spout and the discharge opening.

Figure 9A:
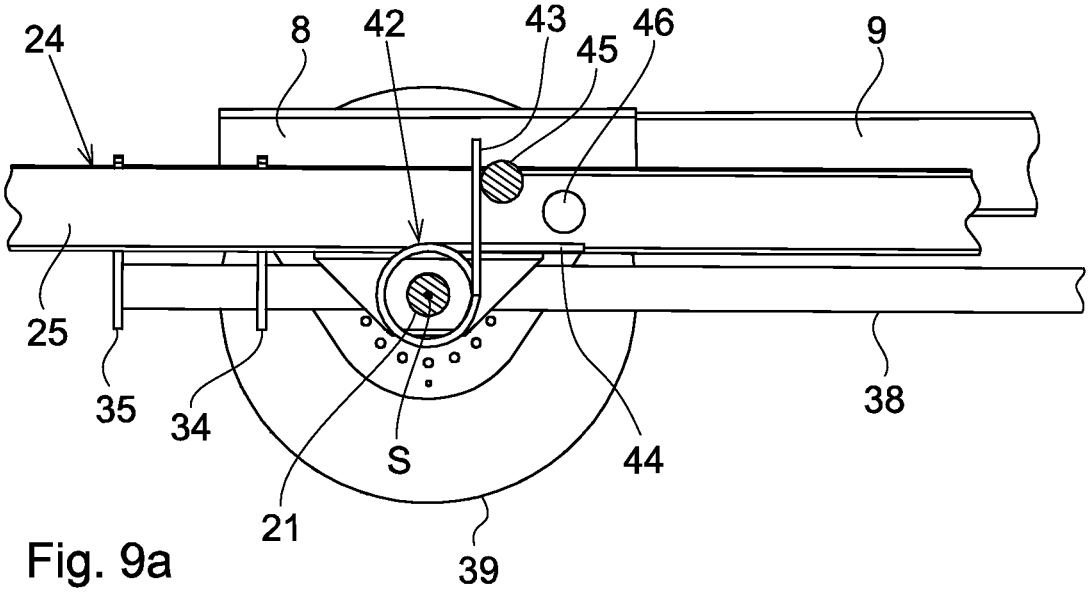
FIGS. 9*a* and 9*b* show the cleaning apparatus in partially cut away side views.
Figure 9B:
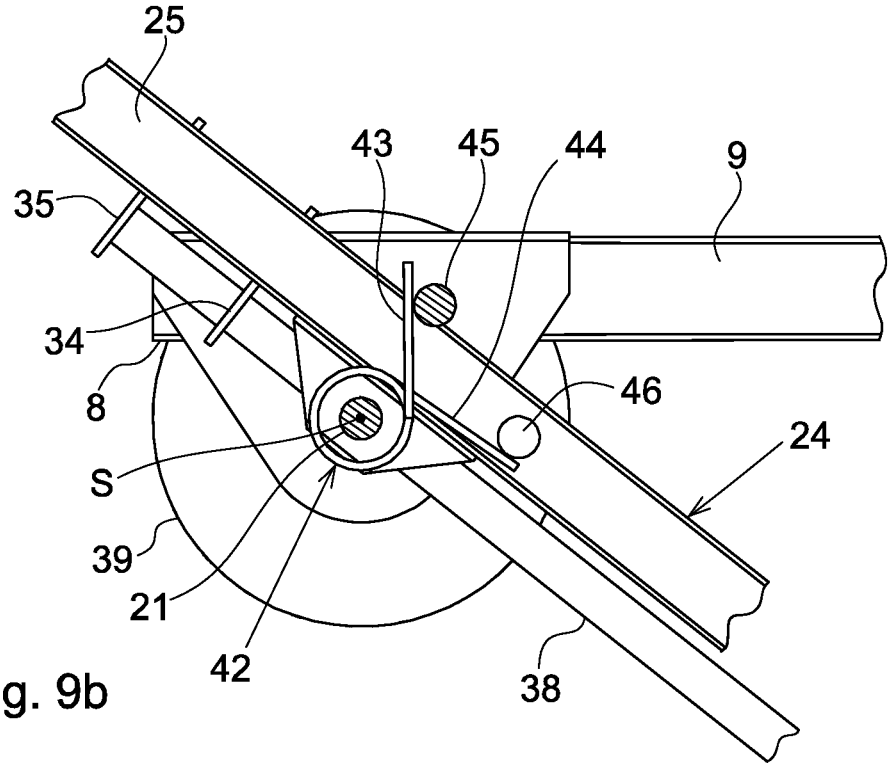

In the outer end of the arms 8 and 9, the drive mechanism 11 for a cleaning rod is arranged to pivot about an axis S which is defined by a couple of pivot pins (invisible in FIGS. 3 and 4, but one is shown in FIGS. 9*a* and 9*b* and here denoted by its reference number 21). The pivot pins 21 are journaled in a couple of console elements 22 and 23, each of which is attached in an outer end of an arm 8 or 9 respectively. Between these console elements, a swing 24 is suspended pivotally by its mounting to the pivot pins 21, which are coupled to the opposite, longitudinal sides of the swing. The swing 24 comprises a chassis frame 25 having longitudinal and transverse frame members. Inside the chassis frame 25, a driver 26 is arranged to slide on a couple of guide bars 27 and 28 that are extended in the length of the chassis frame, between the transverse frame members. The driver houses a couple of slide bearings 29 and 30 which are journaled on the associated guide bars 27 and 28. Between the slide bearings, a threaded nut 31 is non-rotationally affixed to the driver 26. A threaded bar 32 passes the nut in threaded engagement. One end of the bar 32 is rotationally journaled in the inner end of the chassis frame, whereas the opposite end of the bar 32 projects from the chassis frame for operative engagement with an actuator 33 which is controllable for rotation of the bar 32 in either direction of rotation. The nut 31 and the bar 32 can be realized as a ball-screw. The nut 31, the bar 32 and the actuator 33 function similar to a rack and pinion drive operable for moving the driver 26 in rectilinear, reciprocating motion, i.e. in extension and retraction motion, along the guide bars, by controlling the direction of rotation in the actuator 33. In that sense the actuator 33 is a linear actuator 33.

The linear actuator 33 advantageously includes a servomotor with encoder that provides feedback on the revolutions of the motor axis to a control system that correlates the operation of the linear actuator with the operation of a pivot actuation means, as will be further described hereinafter. The driver 26 further includes structural members in the form of a couple of plates 34 and 35, which are interconnected through the housings 36 and 37 that accommodate the slide bearings 29 and 30. As is best seen in FIGS. 9*a* and 9*b*, these plates 34 and 35 project below the chassis frame 25 to provide an anchorage for a cleaning rod 38 under the swing. Obviously, the driver may alternatively be shifted 180° for holding the cleaning rod above the swing, if appropriate. A support bracket (not illustrated) may optionally be arranged in the inner end of the chassis frame to help guiding the cleaning rod in its back and forth movement. The cleaning rod 38 is an elongate, solid or tubular element.

In this connection, it can be pointed out although not explicitly illustrated in the drawings, that the cleaning rod 38 may be anchored in the driver 26 by means of elastic elements, such as rubber or polymer bushings, in order to prevent shocks from impact with encrusted material to be transferred to the components of the drive mechanism. It serves also to be mentioned, although not being an essential part of the present invention, that the cleaning rod may be arranged for carrying exchangeable cleaning tools in its forward end or tip 38'.

Pivoting of the cleaning rod drive mechanism 11 is accomplished and controlled through a pivot actuation means. In the embodiment of FIGS. 3 and 4 the pivot actuation means comprises an angular actuator 39 which is drivingly coupled to one of the pivot pins 21. An angle position sensor 40 may be realized as an incremental encoder which monitors the change in pivot angle about the pivot axis S, and thus provides an indication of the angular position of the cleaning rod. The angular actuator 39 and the angle position sensor 40 are thus both operatively coupled to the pivot axis S of the swing 24. The readings made by the sensor 40 form the basis for controlling the operation and supply of power to the angular actuator 39.

However, the readings made by the angle position sensor 40 are also used for controlling the speed or amount by which the cleaning rod 38 is retracted or extended upon pivoting of the cleaning rod 38.

Figure 10:
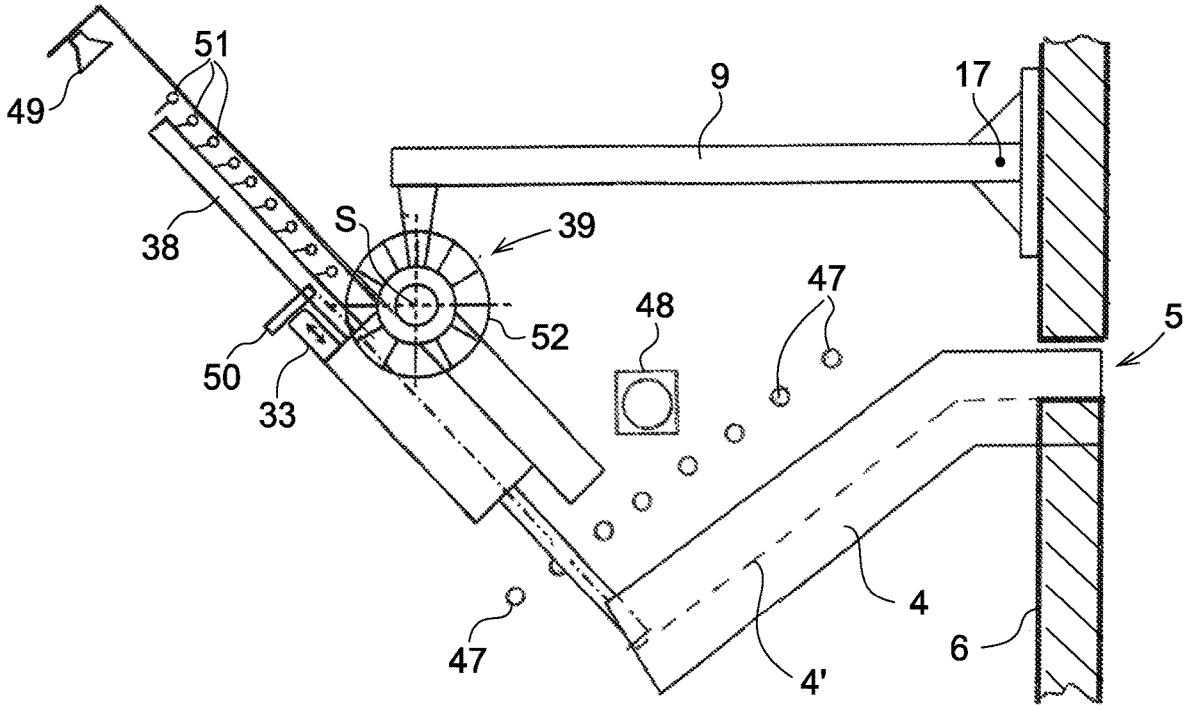
FIG. 10 shows alternative arrangements of sensors installed to monitor axial and pivoting motions of the cleaning rod.

In this connection, reference is made to FIG. 10 for alternatives to the angle position sensor 40 depicted in FIG. 4. When the cleaning rod drive mechanism is pivoted for cleaning the smelt spout by running the tip 38' of the cleaning rod along the spout, the axial movement of the cleaning rod is correlated with the change in its angular orientation in order to compensate for change in the distance between the bottom of the spout and the cleaning rod as the latter is swung about the pivot axis S. If for example the swinging motion is made at constant speed, then the speed of axial movement may need to be increased, in some cases increased progressively, towards the end of the spout.

An example of the correlation between the axial and pivotal movements of the cleaning rod is illustrated in the diagram of FIG. 6. The curve in the diagram represents the acceleration of the retraction movement (x) as a function of increasing pivot angle (φ).

The diagram of FIG. 6 intends to illustrate the functionality built into the cleaning apparatus for ensuring that there is always a clearance maintained between the metallic spout bottom and the tip of the cleaning rod. However, depending on the prevailing geometrical conditions, the correlation between the axial and pivotal movements of the cleaning rod may show other characteristics than those shown in FIG. 6. In other alternatives, e.g., it may be more appropriate to apply a constant retraction or extension of the cleaning rod while adjusting the velocity of the pivoting motion by regulation of the power that is supplied to the pivot actuation means.

In all cases, the correlation is computed in a control unit running a software coded routine which uses the dynamic inputs from one or more sensors or detectors together with, e.g., static data, such as the spatial coordinates and inclination of the smelt spout and the maximum extension of the cleaning rod, which can be used to initiate the pivoting motion. Instead of static data or in combination therewith, proximity sensors may be used to define continuously the position of the cleaning rod in extension and retraction modes.

The readings from the sensors or detectors are thus used for controlling the operation of the linear actuator 33 and/or the pivot actuation means 39, 41 in order to correlate and synchronize the axial and pivotal movements of the cleaning rod. This correlation may include not only a controlled retraction of the cleaning rod, but also a controlled extension of the cleaning rod if required, depending on the subject geometries. In typical cases, the correlation includes controlling the power supply, running time and rotational direction in the linear and/or pivot actuator means so as to maintain the tip of the cleaning rod at a minimum distance of about 1 mm to about 20 mm from the bottom of the smelt spout. In some cases, the distance may vary within about 1 mm to about 50 mm from the bottom of the smelt spout (depending, e.g., on the amount and status of the encrustations which are blocking the smelt spout).

For example, readings by sensors for detecting the angular and axial position of the cleaning rod can be recorded in the control unit during a first setup run wherein the cleaning rod is pivoted along the smelt spout at defined force. The recorded data is thereafter used for controlling the linear actuator 33 and the angular actuator 39 in successive strokes wherein the cleaning rod is pivoted along the smelt spout with controlled motion and force.

Figure 7A:
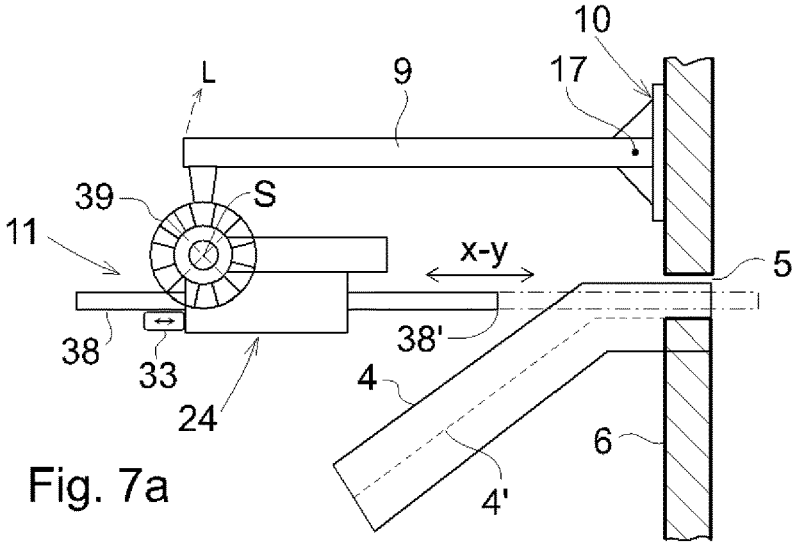
FIGS. 7*a*-7*c* show sequential steps of a cleaning session.
Figure 7B:
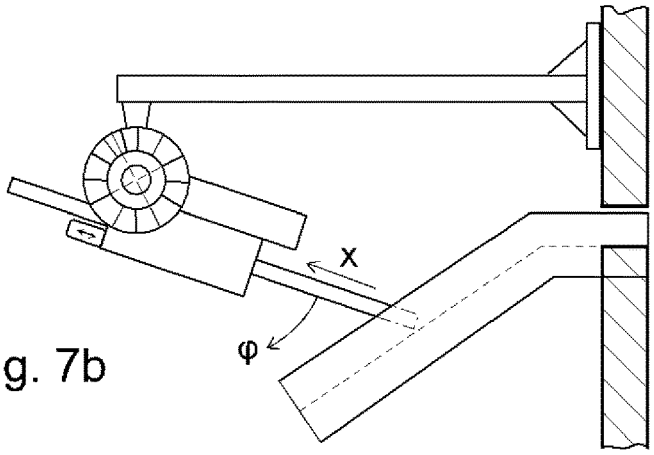
Figure 7C:
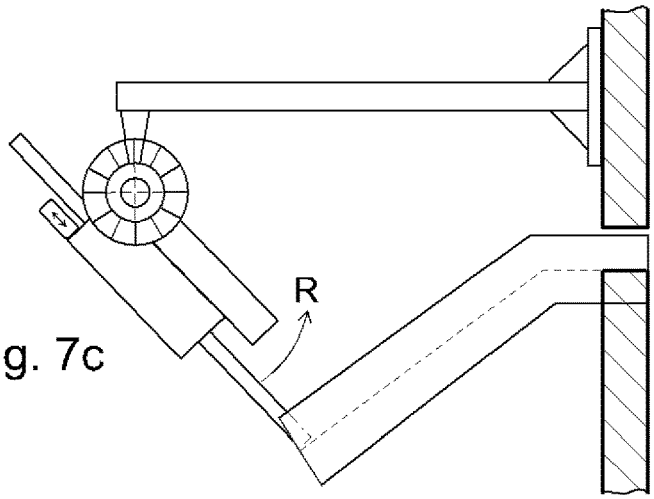

The operation of the cleaning apparatus during a cleaning session is schematically illustrated in the sequential views of FIGS. 7*a*-7*c*. Accordingly, in FIG. 7*a*, the double arrow x-y illustrates the axial movements (extension (y) and retraction (x)) of the cleaning rod during cleaning of the smelt discharge opening 5.

This motion is mainly horizontal, meaning that the orientation of the cleaning rod preferably lies within a few degrees' interval over or under the horizontal plane. In fact, the expression "mainly horizontal" shall be understood to include a deviation from the true horizontal of less than +/−45°, such as within an interval of +/−30°, or even more preferred in the interval of +/−15° of elevation.

During the cleaning sequence depicted in FIG. 7*a*, the angular actuator 39 is inactive whereas the linear actuator 33 may be alternately driven in both directions of rotation for either extension or retraction of the cleaning rod. In alternative embodiments, the cleaning rod may optionally be arranged for turning around its own axis as is known in the art, in order to facilitate cleaning all parts of the periphery of the discharge opening. In the sequence (FIG. 7*a*) of removing solid or encrusted material from the smelt discharge opening, the cleaning rod may need to be repeatedly retracted and extended until it penetrates the opening. In order to protect the components of the cleaning rod drive mechanism from excessive load the whole assembly may be lifted by pivoting at the pivot points 17 which journal the arms 8, 9 to the boiler wall 6 or to the fixture frame 10. This protective action is indicated by the dashed arrow L in FIG. 7*a*.

An overload protection for the cleaning rod drive mechanism may alternatively include a resilient and elastic anchoring of the inner arm ends in the fixture frame 10, or as a third alternative, a resilient and elastic attachment of the console elements 22 and 23 to the outer ends of the arms 8 and 9.

FIG. 7*b* illustrates the sequence of cleaning the smelt spout 4 by running the tip of the cleaning rod down the smelt spout. Since the cleaning rod tip passes along the smelt spout with a few millimeters' clearance to the smelt spout bottom, a small rest of encrusted material may remain in the bottom of the smelt spout also after the cleaning rod tip has passed. This way, the thin layer of encrusted material which remains in the bottom of the smelt spout protects the spout bottom from the hot smelt that will pour down the spout following upon a cleaning session.

During this sequence, the angular actuator 39 is operated for pivoting the cleaning rod as shown by the arrow φ, whereas the linear actuator 33 is controlled for retraction x of the cleaning rod, in synchronization with the pivoting motion as previously explained.

In this connection it should be observed that the speed of the pivoting motion may be adapted to the flow velocity of the smelt in the smelt spout in order to avoid splatter. After completed cleaning, the cleaning apparatus is returned to its initial position by reversed operation of the angular actuator 39 as illustrated by the arrow R in FIG. 7*c*.

Figure 8A:
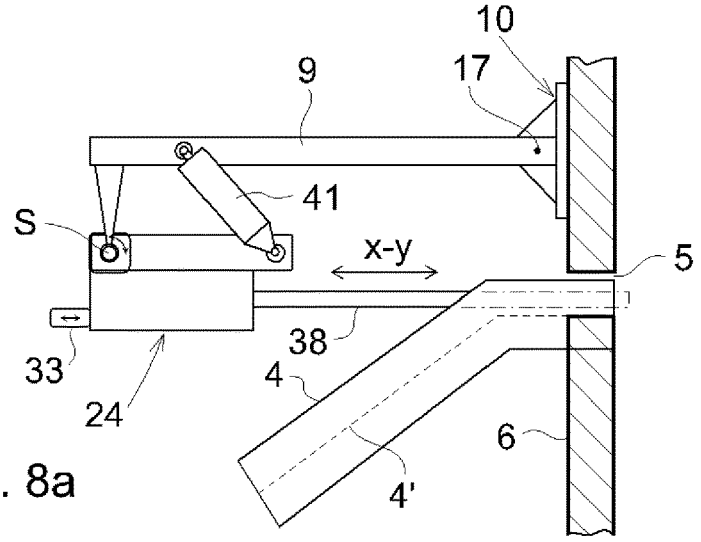
FIGS. 8*a*-8*c* show the same sequential steps performed by an alternative embodiment.
Figure 8B:
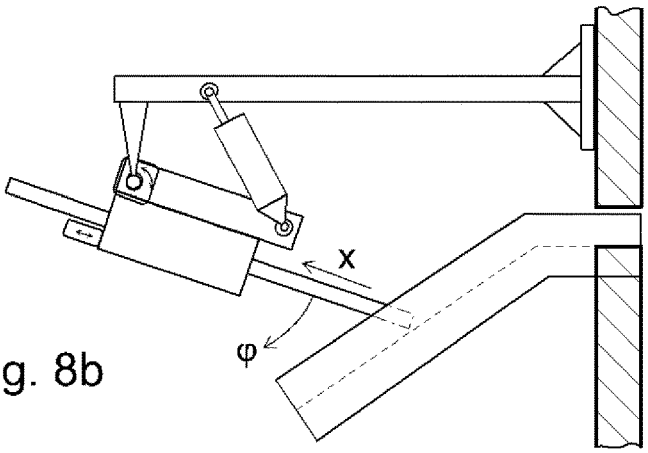
Figure 8C:
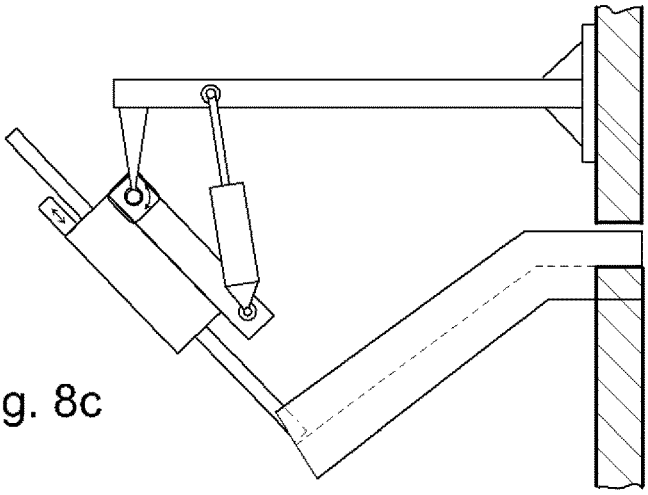

The same modus operandi is performed by the slightly modified embodiment shown in FIGS. 8*a*-8*c*. The only difference from the previous embodiment is that in the embodiment of FIGS. 8*a*-8*c*, the pivot actuation means is a linear actuator 41, such as a piston-cylinder unit, instead of the angular actuator 39.

The linear and angular actuators 33, 39 and 41 may be realized as double-acting or reversible operation drives, powered by air, hydraulic fluid or electricity. The angular actuator 41 may alternatively include a single acting, spring return piston/cylinder unit.

In yet an alternative, an external spring may be applied outside the angular actuator, and more specifically for either of two alternative purposes: i) external spring(s) applied and dimensioned for returning the cleaning apparatus to its initial position, or ii) external spring(s) applied and dimensioned to provide a more even load and thus avoiding load peaks in the angular actuator as the cleaning rod tip travels down an unevenly encrusted smelt spout. In FIGS. 9*a* and 9*b*, a torsion spring 42 is shown in unloaded state (FIG. 9*a*) and loaded state (FIG. 9*b*) respectively. The spring 42 is arranged to apply a counter force that is centered about the pivot axis S as the cleaning rod and cleaning rod drive mechanism are pivoted downwards. For example, one such spring 42 can be supported on each pivot pin 21 that journals the swing 24 to the arms 8 and 9 respectively. The spring 42 comprises a couple of legs 43 and 44, which are actuated upon by a couple of pins 45 and 46. A first pin 45 is stationary arranged on the inner side of the arm 8 or 9 and serves for arresting the leg 43, whereas a second pin 46 is arranged on the outer side of the swing 24, opposite the inside of the arm, the second pin engaging the leg 44 for tensioning of the torsion spring 42 in the pivoting motion of the swing (FIG. 9*b*). The torsion spring 42 can be dimensioned to serve either purpose i) or ii) as discussed above.

With reference to FIG. 10, the change in angular position of the cleaning rod 38 can alternatively be monitored by optical detectors 47 overviewing the pathway of the cleaning rod during the pivoting motion. Optical detectors may be realized as light transmitters and receivers arranged transversally to the plane of the pivoting motion. An optical detector of the change in angular position may alternatively be realized as a fixed position video camera 48 with associated image processing software. The change in angular position may alternatively be detected indirectly by means of a proximity sensor 49 that detects a change in axial position of the cleaning rod 38. Given the geometrical conditions on the site of operation, the control software can be programmed to adapt the pivoting motion to the change in axial position by corresponding control of the pivot actuation means, such that the tip of the cleaning rod can follow closely the inclination of the smelt spout.

With further reference to FIG. 10, reference number 50 denotes an encoder included in the linear actuator 33 and which registers the number of revolutions made by the motor of the linear actuator, whereas reference number 51 denotes one or several end position sensors or limit switches that either detect an end position or detect the moment at which the cleaning rod 38 runs free of the smelt spout 4, and/or detect any intermediate axial position of the cleaning rod. Reference number 52 refers to an encoder associated with the angular actuator 39.

From the above description it will be realized, that the present cleaning apparatus and method shall not be strictly limited to use and application in connection with recovery of pulp cooking chemicals from black liquor in soda recovery boilers, but that the apparatus' structure and operation is likewise useful in connection with any similar process performed in chemicals recovery furnaces and boilers in general.

It should also be noted that, in prior art, spout cleaning has involved driving the cleaning tool upwards along the spout. Although not being a preferred practice, an upwards cleaning of the spout would still benefit from the correlation between rod pivoting and axial movements as provided by the cleaning apparatus of the present invention. The invention is thus not limited to correlation between pivoting and retraction applied in downwards cleaning mode, but is likewise applicable to pivoting during extension of the cleaning rod in upwards cleaning mode.

The invention claimed is:

1. An apparatus comprising:

a chassis frame having a length dimension and a transverse dimension, the chassis frame pivotally journaled about a horizontal axis in a supporting arm that is fixed relative to a chemicals recovery boiler;

a pivot actuation means configured for acting on the chassis frame and operable for pivoting the chassis frame about the axis;

a cleaning rod supported on the chassis frame in a driver member that is arranged slidable on guide bars extending in the length direction of the chassis frame;

a linear actuator operable for moving the driver member in back-and-forth movements on the guide bars for linear retraction (x) and linear extension, respectively, of the cleaning rod in axial directions of the cleaning rod;

and one or more sensors configured to provide signals used for active control of the pivot actuation means and the linear actuator, to thereby adaptively control linear retraction of the cleaning rod relative to a downwards swinging motion of the chassis frame and cleaning rod.

2. The apparatus of claim 1, wherein the one or more sensors monitor at least one of rod axial movement and rod pivoting movement, wherein operation of at least one of the linear actuator and the pivot actuation means is based on output from the one or more sensors.

3. The apparatus of claim 2, wherein the one or more sensors is a rod axial motion sensor, and wherein the pivot actuation means is arranged for adjusting a speed of a pivoting movement (φ) of the cleaning rod based on readings from the rod axial motion sensor monitoring axial movements (x; y) of the cleaning rod during pivoting of the cleaning rod.

4. The apparatus of claim 3, wherein the rod axial motion sensor is at least one of:

a proximity sensor;

one or more limit switches or end position sensors;

and/or an encoder in a servomotor of the linear actuator.

5. The apparatus of claim 2, wherein the one or more sensors is an angle position sensor, and wherein the linear actuator is arranged for adjusting a speed of axial movements (x; y) of the cleaning rod based on readings from the angle position sensor monitoring a change in pivot angle (φ) during pivoting of the cleaning rod.

6. The apparatus of claim 5, wherein the angle position sensor is at least one of:

a set of light sensors or photo cells monitoring a pivot area of the cleaning rod;

a fixed position video camera with associated image processing software; and/or an encoder in a servomotor of the pivot actuation means.

7. The apparatus of claim 1, wherein the driver member comprises one of:

a rack and pinion drive;

a ball-screw; or a trapezoidal threaded bar mechanism.

8. The apparatus of claim 1, wherein at least one of the sensors is an angle position sensor operatively coupled to the axis, wherein said sensor is configured for monitoring a change in angular position of the cleaning rod.

9. The apparatus of claim 1, wherein the pivot actuation means is one of: an angular actuator or a second linear actuator.

10. The apparatus of claim 1, wherein the supporting arm is journaled in a fixture frame, the fixture frame defining a slot that is dimensioned to receive an upper end of a smelt spout when the fixture frame is aligned with a smelt discharge opening through a wall of the chemicals recovery boiler.

11. The apparatus of claim 10, wherein the fixture frame comprises, in a side facing the chemicals recovery boiler, stud holes mating with corresponding studs arranged on an adapter plate that is connectable to the wall of the chemicals recovery boiler.

12. The apparatus of claim 10, wherein two supporting arms are in parallel and are pivotally journaled in the fixture frame.

13. A method of cleaning a smelt spout and a smelt discharge opening of a chemicals recovery boiler by using a cleaning apparatus comprising: a chassis frame having a length dimension and a transverse dimension, the chassis frame pivotally journaled about a horizontal axis in a supporting arm that is fixed relative to a chemicals recovery boiler; a pivot actuation means configured for acting on the chassis frame and operable for pivoting the chassis frame about the axis; a cleaning rod supported on the chassis frame in a driver member that is arranged slidable on guide bars extending in the length direction of the chassis frame; a linear actuator operable for moving the driver member in back-and-forth movements on the guide bars for linear retraction (x) and linear extension, respectively, of the cleaning rod in axial directions of the cleaning rod; and one or more sensors configured to provide signals used for active control of the pivot actuation means and the linear actuator, wherein the method comprises:

sequentially extending and retracting the cleaning rod axially in a step of cleaning the smelt discharge opening; and pivoting the cleaning rod in a step of cleaning the smelt spout, wherein axial movements (x; y) of the cleaning rod are correlated with the change in pivot angle (φ) during pivoting of the cleaning rod based on readings from one or more sensors, wherein linear retraction of the cleaning rod is adaptively controlled relative to a downwards swinging motion of the chassis frame and cleaning rod.

14. The method of claim 13, comprising the steps of:

monitoring the change in pivot angle (φ) during the pivoting movements; and adjusting the speed of the axial movements (x; y) based on readings of the change in pivot angle (φ).

15. The method of claim 14, wherein the speed of the axial movement (x; y) is increased progressively with increasing pivot angle (φ).

16. The method of claim 13, comprising the steps of:

monitoring the axial movement (x; y) of the cleaning rod during the pivoting movement; and adjusting the speed of the pivoting movement (φ) based on readings of the axial movement.

17. The method of claim 13, wherein the tip of the cleaning rod is maintained at a minimum distance of about 1 mm to about 20 mm from the bottom of the smelt spout throughout the pivoting movement.

18. The method of claim 13, wherein initiation of a cleaning session is based on readings from a temperature sensor monitoring the temperature in the smelt spout.

* * * * *